US007152448B2

(12) United States Patent
Zhu et al.

(10) Patent No.: US 7,152,448 B2
(45) Date of Patent: Dec. 26, 2006

(54) CONTINUOUS EQUAL CHANNEL ANGULAR PRESSING

(75) Inventors: Yuntian T. Zhu, Los Alamos, NM (US); Terry C. Lowe, Santa Fe, NM (US); Ruslan Z. Valiev, Ufa (RU); Georgy J. Raab, Ufa (RU)

(73) Assignee: Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 11/014,072

(22) Filed: Dec. 16, 2004

(65) Prior Publication Data

US 2006/0130549 A1 Jun. 22, 2006

(51) Int. Cl.
*B21C 23/00* (2006.01)

(52) U.S. Cl. ..... 72/262; 72/259

(58) Field of Classification Search ..... 72/253.1, 72/256, 259, 262, 270, 271, 272, 467
See application file for complete search history.

(56) References Cited

U.S. PATENT DOCUMENTS

| | | | | |
|---|---|---|---|---|
| 3,765,216 | A | 10/1973 | Green | |
| 4,041,745 | A * | 8/1977 | Moreau | 72/60 |
| 4,055,979 | A | 11/1977 | Hunter et al. | |
| 4,101,253 | A | 7/1978 | Etherington | |
| 5,284,428 | A | 2/1994 | Sinha et al. | |
| 5,503,796 | A | 4/1996 | Sinha et al. | |
| 5,513,512 | A * | 5/1996 | Segal | 72/253.1 |
| 6,370,930 | B1 | 4/2002 | Lee et al. | |
| 6,399,215 | B1 | 6/2002 | Zhu et al. | |
| 6,571,593 | B1 | 6/2003 | Chung et al. | |
| 6,895,795 | B1 * | 5/2005 | Chaudhury et al. | 72/262 |
| 2004/0250588 | A1 * | 12/2004 | Lev et al. | 72/184 |

FOREIGN PATENT DOCUMENTS

JP 6-226335 * 8/1994

OTHER PUBLICATIONS

R. Z. Valiev, I. V. Alexandrov, Y. T. Zhu and T. C. Lowe, "Paradox of Strength and Ductility in Metals Processed by Severe Plastic Deformation," Journal of Materials Research, vol. 17 (2002) pp. 5-8.

Minoro Furukawa, Zenji Horita, and Terence G. Langdon, "Developing Ultrafine Grain Sizes Using Severe Plastic Deformation," Advanced Engineering Materials, vol. 3, No. 3 (2001) pp. 121-125.

(Continued)

*Primary Examiner*—Ed Tolan
(74) *Attorney, Agent, or Firm*—Samuel L. Borkowsky

(57) ABSTRACT

An apparatus that continuously processes a metal workpiece without substantially altering its cross section includes a wheel member having an endless circumferential groove, and a stationary constraint die that surrounds the wheel member, covers most of the length of the groove, and forms a passageway with the groove. The passageway has a rectangular shaped cross section. An abutment member projects from the die into the groove and blocks one end of the passageway. The wheel member rotates relative to the die in the direction toward the abutment member. An output channel in the die adjacent the abutment member has substantially the same cross section as the passageway. A metal workpiece is fed through an input channel into the passageway and carried in the groove by frictional drag in the direction towards the abutment member, and is extruded through the output channel without any substantial change in cross section.

10 Claims, 6 Drawing Sheets

OTHER PUBLICATIONS

R. Z. Valiev, R. K. Islamgaliev, and I. V. Alexandrov, Bulk Nanostructured Materials From Severe Plastic Deformation, Progress in Materials Science, vol. 45 (2000) pp. 103-189.

Honggang Jiang, Y. Theodore Zhu, Darryl P. Butt, Igor V. Alexandrov, and Terry C. Lowe, "Microstructural Evolution, Microhardness and Thermal Stability of HPT-Processed Cu," Materials Science and Engineering, vol. A290 (2000) pp. 128-138.

J. Huang, Y. T. Zhu, H. Jiang and T. C. Lowe, "Microstructures and Dislocation Configurations in Bulk Nanostructured Cu Processed by Repetitive Corrugation and Straightening," Acta Materialia, vol. 49 (2001) pp. 1497-1505.

Y. Saito, H. Utsunomiya, H. Suzuki, and T. Sakai, "Improvement in the r-Value of Aluminum Strip by a Continuous Shear Deformation Process," Scripta Materialia, vol. 42 (2000) pp. 1139-1144.

J.-C. Lee, H. K. Seok, and J. Y. Suh, "Microstructural Evolutions of the Al Strip Prepared by Cold Rolling and Continuous Equal Channel Angular Pressing," Acta Materialia, vol. 50 (2002) pp. 4005-4019.

Y. H. Kim, J. R. Cho, K. S. Kim, H. S. Jeong, and S. S. Yoon, "A Study of the Application of Upper Bound Method to the CONFORM Process," Journal of Materials Processing Technology, vol. 97 (2000) pp. 153-157.

J. R. Cho and H. S. Jeong, "Parametric Investigation on the Curling Phenomenon in CONFORM Process by Three-Dimensional Finite Element Analysis," Journal of Materials Processing Technology, vol. 110 (2001) pp. 53-60.

* cited by examiner

CONTINUOUS EQUAL CHANNEL ANGULAR PRESSING

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to extrusion and more particularly to an apparatus and method for continuous equal channel angular pressing a solid workpiece without substantially changing the cross-section of the workpiece.

BACKGROUND OF THE INVENTION

Plastic deformation by rolling, extrusion and drawing often increases the strength of metal alloys, but decreases their ductility [1]. By contrast, processing metals and alloys by severe plastic deformation (SFD) can increase their strength while maintaining good ductility by forming ultrafine grains (UFGs), and subgrains, from smaller than 100 nanometers (nm) to about 1000 nanometers [2]. The combination of high strength and good ductility makes SPD-produced ultrafine-grained (UFG) materials very attractive for medical implants [3], aerospace structures, sporting goods, automobile parts and other devices.

Among the SPD techniques, "equal channel angular pressing" (ECAP), also known in the art as "equal channel angular extrusion" (ECAE™), has attracted much attention because it is very effective in producing UFG structures and can produce UFG billets that are large enough for practical structural applications [4]. Only High Pressure Torsion (HPT) [5] is more effective in producing UFG structures. However, HPT can only produce small disks with a typical diameter of about 10 millimeters (mm) and a thickness of less than about 1 mm. These dimensions make them unsuitable for most structural applications. By contrast, ECAP has been used to produce billets that are long enough and wide enough for some practical structural applications.

The original ECAP technique involves pressing a workpiece through a die with two channels that are equal in cross-section and intersect each other at an angle. Sending the workpiece through the die refines the microstructure, and when the die cross-section is circular or square shaped, the workpiece can be turned 90 degrees and extruded again and again because the shape and size of the workpiece does not change substantially during the pressing.

The ECAP technique in its original design has some limitations: the aspect ratio (i.e. the length to diameter ratio) of the workpiece must be smaller than a critical value so that the workpiece does not bend during the pressing, and the ram that forces the workpiece through the die has a limited travel distance. These aspects of the ECAP technique place limits on the length of the workpiece and make ECAP a discontinuous process with low production efficiency and high cost. In addition, a significant length near each end of a workpiece is usually cracked and has to be removed, wasting a significant portion of the workpiece and further increasing the cost of the product. The discontinuous nature of ECAP and the wasted portions of the processed workpiece make UFG products expensive, which limits their applications to high-valued markets such as medical implants and devices where the cost of the materials is a relatively minor portion of the total cost. A key to commercializing the preparation of UFG materials is to lower their processing cost and minimize waste through continuous processing.

In the early 1970's, Green and Etherington developed an effective process, now known as the CONFORM™ process, which is directed to continuous rotary extrusion that converts powder feedstock into a long solid article [6]. Briefly, a CONFORM™ apparatus includes a disk and a shoe that provide frictional force to drive feedstock through the apparatus. Feedstock is sent through a channel formed in between the disk and the shoe. A groove in the disk covered with the stationary shoe forms the channel, and the contact interface between the feedstock and the shoe results in dragging frictional force. The feedstock has three interfaces driving it forward and one interface dragging it backward, with a net forward driving force. An abutment on the inner surface of the shoe stops the feedstock and forces it through an outlet. The outlet cross-section usually has a different shape from the groove because the objective of CONFORM™ is to change the geometry of the feedstock (and consolidate the feedstock if powder feedstock is used), which usually requires only one pass. The deformation of the feedstock during extrusion is similar to a conventional extrusion process.

Another continuous method called "repetitive corrugation and straightening" (RCS) has been used to process metal sheets and rods in a continuous manner [7]. RCS is less effective at refining grains than ECAP is, and each RCS pass produces non-uniform strain along the length as well as the thickness of the workpiece.

A coshearing process [8] and a "continuous constrained strip shearing (C2S2) process" [9] were recently reported for continuously processing thin strips and sheets. Both processes use the friction created between the rollers and the workpiece to push the workpiece through a modified ECAP die. The former [8] uses several rollers to increase the frictional force, while the latter uses one set of rollers but employs workpiece thickness reduction to increase the frictional force. Both are limited to processing sheet metals because the frictional force required to push the workpiece through the ECAP die is proportional to the contact area between the workpiece and the rollers, and only a workpiece in sheet form can provide enough frictional force. To process a workpiece in the form of a rectangular bar, more frictional force is needed to push the workpiece through an ECAP die.

No continuous process or apparatus thus far can refine the grain size of a rectangular bar without significantly affecting the cross section. There remains a need for an apparatus and process for the continuous processing of rectangular bars to refine the grain size without substantially affecting the cross section.

Therefore, an object of the present invention is to provide an apparatus for the continuous equal channel angular pressing processing of a rectangular bar workpiece without substantially affecting the cross-section.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention includes an pressing apparatus having a wheel member having an endless circumferential groove therein; a stationary constraint die surrounding the perimeter of said wheel member and covering most of the length of the groove and forming a passageway with the groove having a rectangular shaped cross section; an abutment member projecting from the stationary constraint die into the groove and blocking one end of the passageway; the wheel member being rotatable relative to the stationary constraint die in the direction toward the abutment member; an output orifice in the stationary constraint die adjacent the abutment member and having substantially the same cross section as the cross section of the passageway; and an input orifice for feeding a solid metal workpiece to be extruded into a portion of the passageway remote from the abutment member so that the workpiece is carried in the groove by frictional drag in the direction towards the abutment member and is thereby extruded through the output orifice and without any substantial change in cross section.

The invention also includes a method for continuously extruding metal. The method includes feeding a solid metal workpiece into one end of a passageway formed between a wheel member having an endless groove and a stationary constraint die that surrounds the wheel member and covers some of the length of the groove. The wheel member has a greater surface area for engaging the metal workpiece than the stationary constraint die. The passageway has a closed end remote from the end of the passageway where the workpiece is fed. An outlet at the closed end of the stationary constraint die has substantially the same rectangular cross section as the cross section of the passageway. During operation, the wheel member moves toward the outlet, and the frictional drag of the passageway-defining surfaces of the second member drags the metal workpiece through the passageway and through the outlet.

The invention also includes an pressing apparatus. The apparatus includes a first wheel member having an endless circumferential groove therein; a shoe member covering only part of the length of the groove and forming an input orifice with the groove and a passageway with the groove. The passageway has a rectangular cross section. A solid metal workpiece to be extruded is fed into the input orifice and, from the input orifice, into a portion of the passageway remote from the abutment member. The first wheel member has a greater surface area for engaging the metal workpiece than the shoe member. The apparatus also includes an abutment member that projects from the shoe member into the groove and blocks one end of the passageway. The first wheel member is rotatable relative to the shoe member in the direction toward the abutment member. The shoe member includes an output orifice adjacent the abutment member; the output orifice has substantially the same cross section as the cross section of the passageway. The apparatus also includes a second rotatable wheel member remote from the abutment member of the shoe. The second rotatable wheel member is configured to contact a side of the workpiece, and urges the workpiece into the passageway so that the workpiece is carried in the groove by frictional drag in the direction towards the abutment member and is extruded through the output orifice without any substantial change in cross section.

BRIEF DESCRIPTION OF THE DRAWINGS

The accompanying drawings, which are incorporated in and form a part of the specification, illustrate the embodiment(s) of the present invention and, together with the description, serve to explain the principles of the invention. In the drawings.

DETAILED DESCRIPTION

The present invention includes an apparatus and method for continuously processing rectangular bar feedstock into ultrafine-grained bars without substantially altering the cross-section. Reference will now be made to the present preferred embodiments of the invention, examples of which are illustrated in the accompanying drawings. Similar or identical structure is identified using identical callouts.

Figure 1:
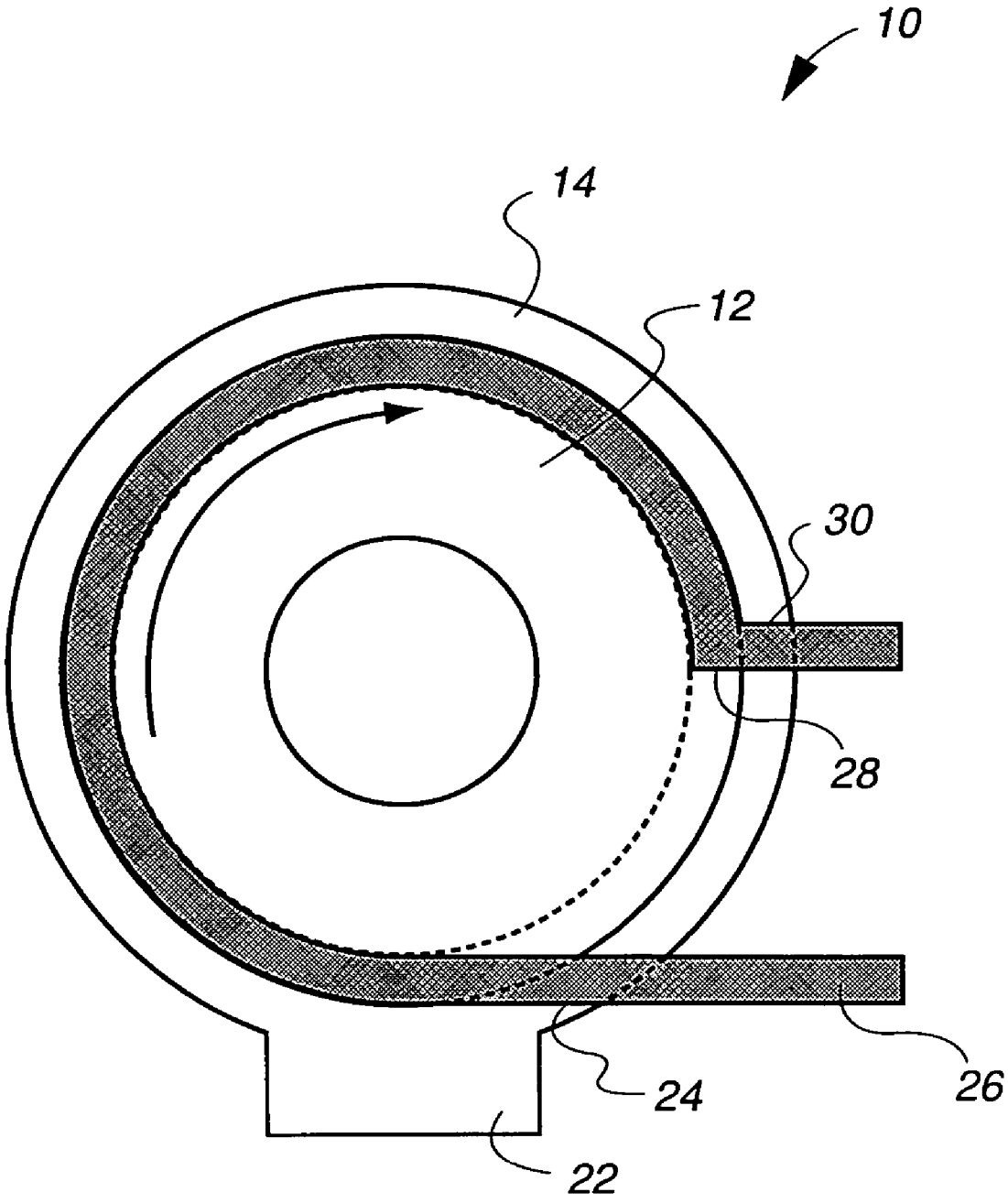
FIG. 1 shows a representation of an apparatus of the invention processing a metal workpiece.
Figure 2:
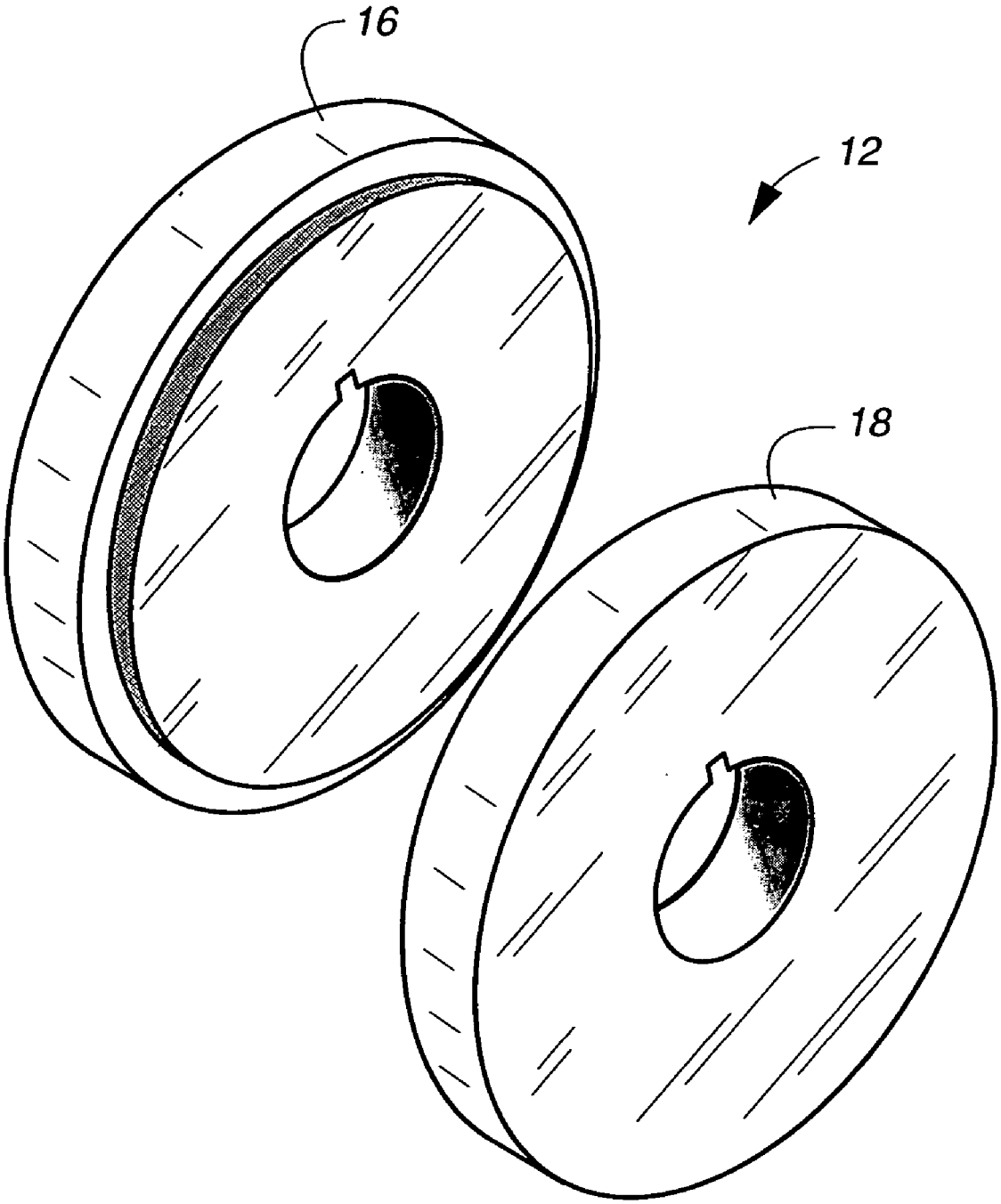
FIG. 2 shows an exploded view of a wheel member used with the apparatus of FIG. 1.
Figure 3:
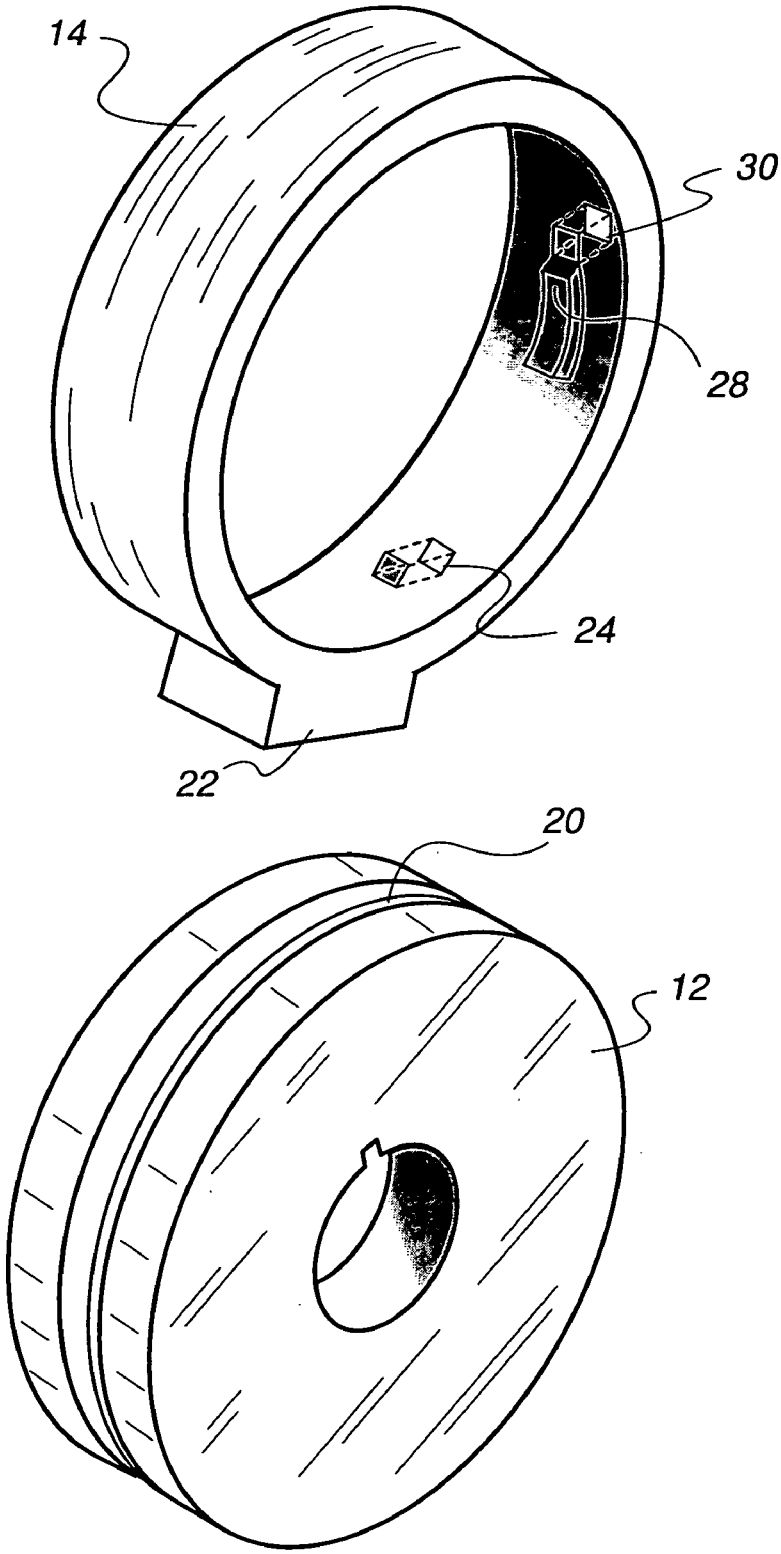
FIG. 3 shows an isometric view of an embodiment wheel member and stationary constraint die of the invention. The stationary constraint die includes an input channel for a metal workpiece, an output channel through which the workpiece is extruded, and an abutment that extends from the stationary constraint die into the groove of the wheel member and diverts the workpiece into the output channel.

Turning now to the figures, FIG. 1 shows a side view of an embodiment apparatus of the invention. Apparatus 10 includes wheel member 12 and stationary constraint die 14 coaxial with, and configured to fit around, wheel member 12. An exploded isometric view of wheel member 12 is shown in FIG. 2, and an isometric view of the wheel member 12 and stationary constraint die 14 are shown in FIG. 3. Wheel member 12 includes first portion 16 and a second portion 18 configured such that when they are joined together, an endless groove 20 about midway along the circumference of wheel 12 is formed. Both first portion 16 and second portion 18 of wheel member 12 are hollow at their respective axes for insertion and attachment of an axle to rotate the wheel. Stationary constraint die 14 includes mounting portion 22 configured for engagement with a workbench (not shown) to prevent stationary constraint die 14 from moving. Stationary constraint die 14 includes an input channel 24 for receiving metal workpiece 26. Die 14 also includes abutment 28 that protrudes from the inside of die 14 and is configured to fit inside groove 20 of wheel member 12. When assembled, groove 20 and die 14 form a passageway with a rectangular cross section through which the metal workpiece 26 moves. Die 14 also includes an outlet channel 30 configured with substantially the same cross section as that of the passageway. During operation; as workpiece 26 moves through the passageway, it reaches abutment 28 and the leading end of the workpiece undergoes shear forces and grain refinement as abutment 28 redirects the workpiece as it is forced out of die 14 through outlet channel 30. This grain refinement results in an improvement in the strength of the workpiece as it is extruded out of the die, and without any significant change in the cross section of the workpiece.

During operation, rectangular bar workpiece 26 enters apparatus 10 through orifice 24 and moves into groove 20 in wheel member 12. Wheel member 12 is rotatable and as wheel member 12 is forced to rotate clockwise for the views shown in FIGS. 1–3, frictional forces are generated with the workpiece 26 from the surfaces of wheel member 12 that define groove 20, and also from the inner surface of the stationary constraint die 14. Groove 20 is slightly wider than workpiece 26 before processing, but after workpiece 26 enters apparatus 10 and starts moving through the passageway, it widens slightly until contacts the surfaces of the wheel that define the groove. The frictional forces exerted by the wheel member 12 and stationary die 14 produce a net force on workpiece 26 that drags it through the passageway in the same direction as wheel member 12. Die 14 constrains workpiece 26 within groove 20 as it moves along until the leading end of the workpiece contacts abutment 28, which forces the workpiece through outlet channel 30. As the workpiece is extruded, it undergoes shear forces that result in grain refinement. In the current set-up, the angle is about 90 degrees, which is the most commonly used channel intersection angle in ECAP. The shear forces are well known and have already been described in the prior art for equal channel angular pressing of metal billets.

Figure 4:
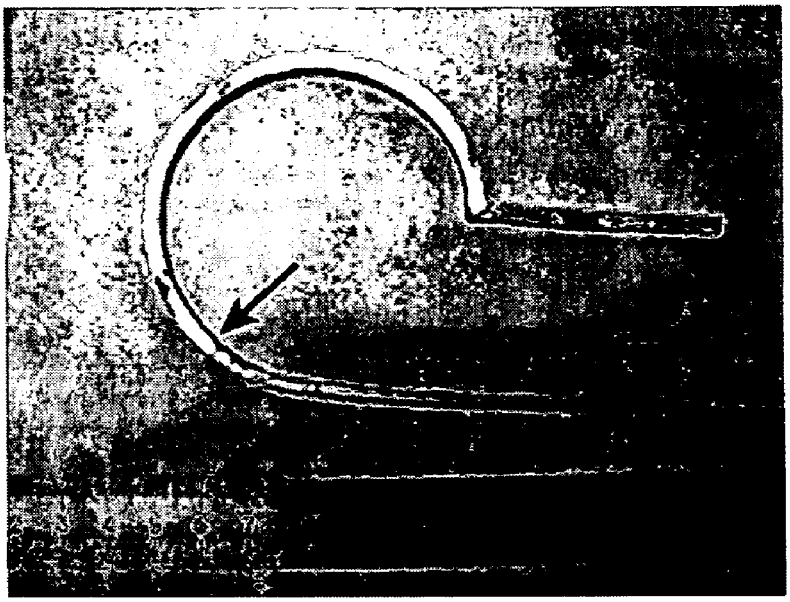
FIG. 4 shows an image of an aluminum bar workpiece during processing using the apparatus of the invention.

The invention was demonstrated using apparatus 10 and an aluminum rectangular bar workpiece. The diameter of the workpiece was about 3.4 millimeters. FIG. 4 shows the bar during processing. Progressing from the end portion of the bar that had not yet entered the apparatus to the leading end that had been extruded, the bar was forced to bend within the groove of the wheel until reaching the abutment on the stationary constraint die. This is clearly shown by the abrupt changes in the shape of the bar from a linear shape (prior to entering the apparatus) to a curved shape (inside the apparatus but before reaching the abutment) to the shape resulting from having been forced through the stationary die at an angle of about 90 degrees. The extruded portion of the bar has a linear shape.

The cross-section of the workpiece after the first pass was 3.78 mm by 2.78 mm. The workpiece was rotated by 180 degrees in between successive passes for a total of 4 passes. The mechanical properties of the aluminum bar were determined after 1 pass, 2 passes, 3 passes, and 4 passes. The data are shown in TABLE 1.

TABLE 1

| Processing state | $\sigma_{0.2}$ (MPa) | $\sigma_u$ (MPa) | $\delta$ (%) | $\Psi$ (%) |
|---|---|---|---|---|
| Starting bar | 47 | 71 | 28 | 86 |
| 1 pass | 130 | 160 | 13 | 73 |
| 2 passes | 140 | 170 | 12 | 72 |
| 3 passes | 130 | 160 | 14 | 76 |
| 4 passes | 140 | 180 | 14 | 76 |

The symbols $\sigma_{0.2}$ and $\sigma_u$ relates to the yield strength and ultimate strength of the bar, respectively, in units of megapascals (MPa). The symbol $\delta$ relates to the percent elongation to failure for the bar. The symbol $\Psi$ relates to the percent necking cross-section reduction of the bar. As the data of TABLE 1 show, the yield strength and ultimate strength of the bar have improved while maintaining good elongation to failure (i.e. ductility) of about 12–14 percent.

Figure 5:
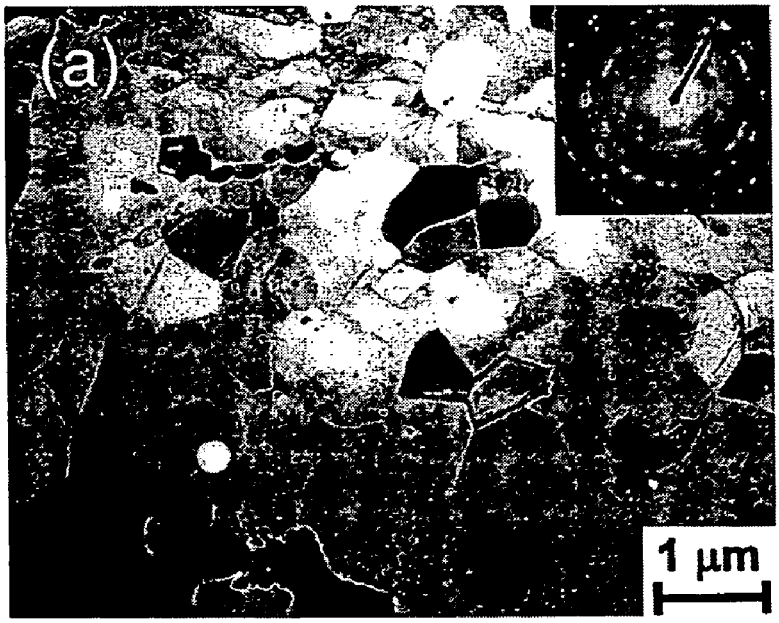
FIG. 5 shows a transmission electron microscopy (TEM) image of a portion of the extruded aluminum bar of FIG. 4 after 4 passes through the apparatus.

FIG. 5 shows a transmission electron microscopy (TEM) image of a portion of the extruded aluminum bar after 4 passes through the apparatus. The image clearly shows that ultrafine-grained structures of the bar have grain sizes below 500 nanometers.

There are differences between the invention and the known CONFORM process. One difference is related to the shear strain in the workpiece generated at the intersection of the die channel and the groove. The invention subjects the workpiece to a pure shear strain that is the same type of strain as in the well-known ECAP process. By contrast, the CONFORM process subjects the workpiece to a more complex strain [10] that is similar to the strain experienced by a workpiece undergoing normal pressing through a narrow opening.

Another difference is related to changes in the shape of the bar workpiece. The invention does not significantly change the shape or cross section of the workpiece (except during the first pass in some cases). This aspect of the invention enables a single workpiece to be processed repeatedly for multiple passes to further improve its strength. By contrast, CONFORM typically changes the shape and cross-section of a workpiece to the extent that workpieces can be passed through a CONFORM apparatus only once.

Another difference is related to the presence of inactive zones in a typical CONFORM apparatus that are absent from the invention. The die used with the CONFORM process usually includes an inactive zone where workpiece gets trapped and does not move. No such zone is present with the invention.

Figure 6:
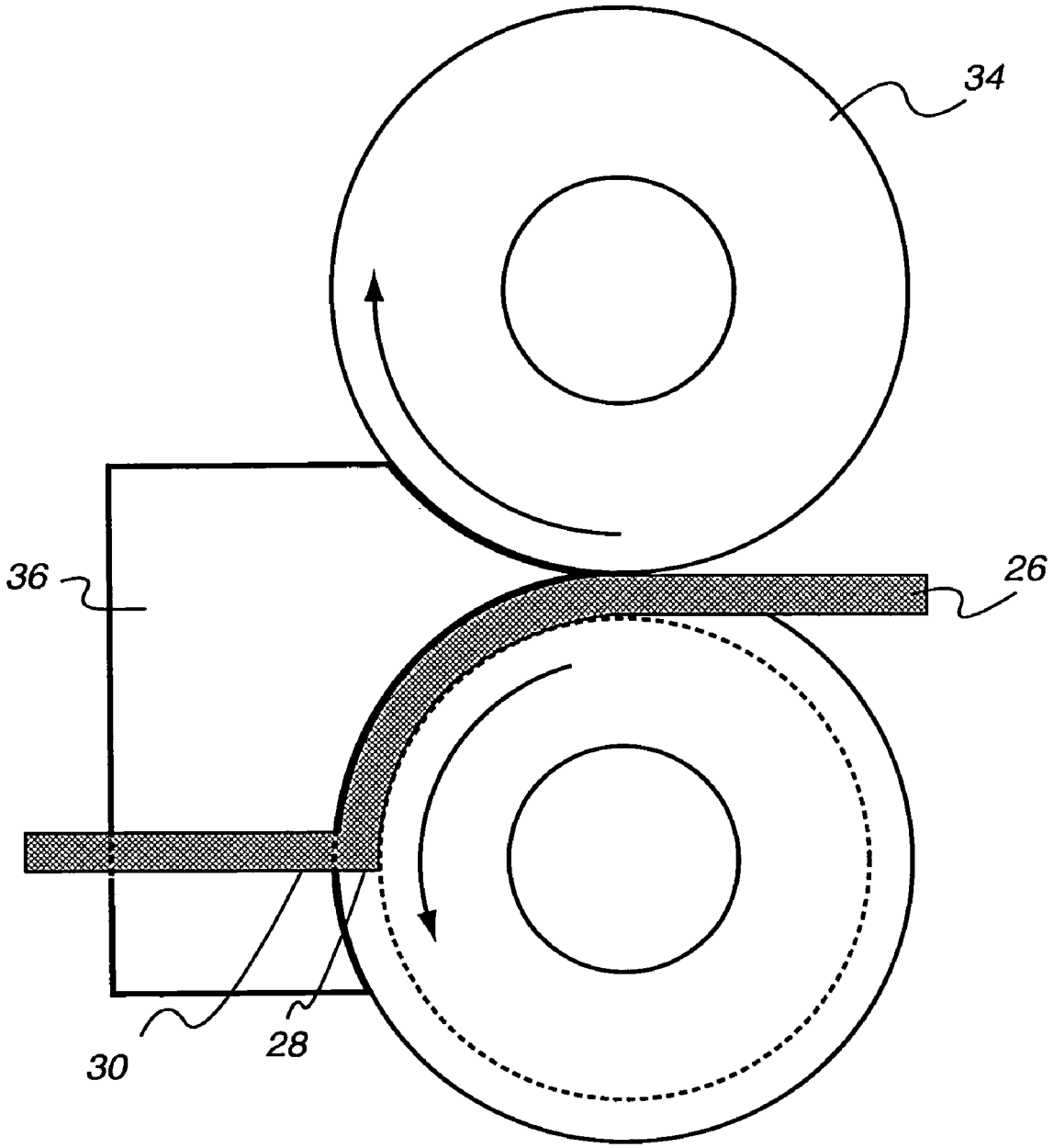
FIG. 6 shows a side view of an embodiment apparatus of the invention that employs two circular disks, one of which drives the rectangular bar workpiece through the apparatus.
Figure 7:
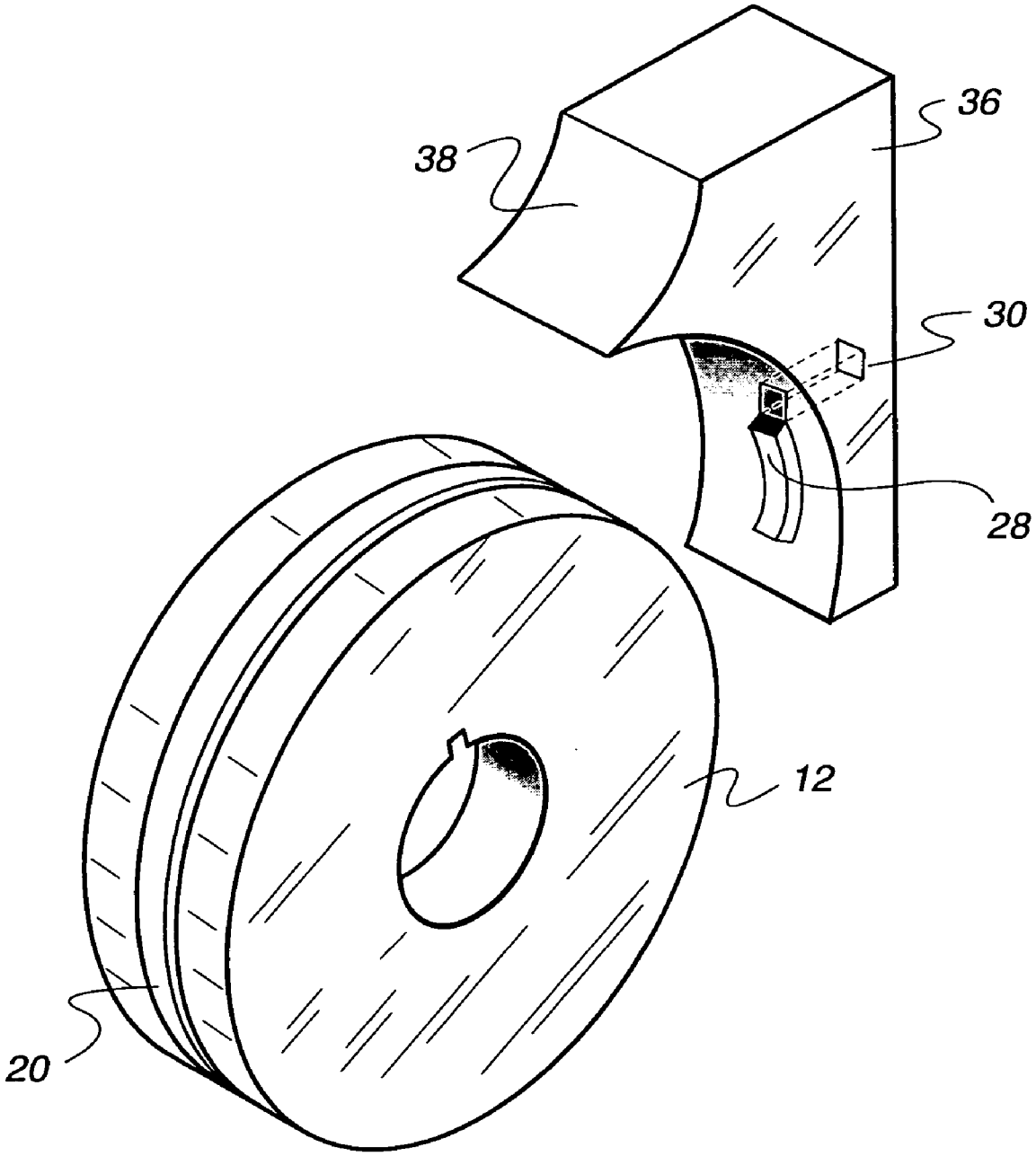
FIG. 7 shows an isometric view of a portion of the apparatus of FIG. 6.

FIG. 6 shows a side view of second embodiment apparatus of the invention, and FIG. 7 shows an isometric view of a portion of the apparatus. Apparatus 32 includes wheel member 12, which is configured as previously described for apparatus 10. Apparatus also includes second wheel member 34, which differs from wheel member 12 in that wheel member 34 does not include groove 20, but instead has substantially flat circumferential surface for contacting and driving workpiece 26, along with wheel member 12, by supplying frictional force with workpiece 26. Apparatus 32 also includes die member 36, which has an inner surface portion similar to that of die 14. As FIG. 7 shows, die member 36 also includes an abutment 28 that protrudes from the inside of die member 36 and is configured to fit inside groove 20 of wheel member 12. When assembled, groove 20 and die 14 form a passageway with a rectangular cross section through which the metal workpiece 26 moves. Die member 36 also includes an outlet channel 30 configured with substantially the same cross section as that of the passageway. During operation, as workpiece 26 moves through the passageway, it reaches abutment 28 and the leading end of the workpiece undergoes shear forces and grain refinement as abutment 28 redirects the workpiece as it is forced out of die 14 through outlet channel 30, the same way as described for apparatus 10. Thus, the grain refinement that occurs results in an improvement in the strength of the workpiece as it is extruded out of the die, and without any significant change in the cross section of the workpiece.

During operation, wheel member rests against surface portion 38 of die member 36 and also against wheel member 32 such that wheel member 32 and wheel member 34 and die member 36 form an entrance through which workpiece enters apparatus 12. As workpiece 26 enters apparatus 32 through this entrance, it moves into groove 20 in wheel member 12. Both wheel member 12 and wheel member 34 are rotatable and as wheel member 34 rotates, wheel member 12 is forced to rotate (clockwise for the views shown in FIG. 6–7. Frictional forces are generated, first between workpiece 26 and both wheel member 12 and wheel member 34, and then between the inner surface of die member 36 and the surfaces of wheel member that define groove 20 as the workpiece moves. As described for apparatus 10, groove 20 is slightly wider than workpiece 26 before processing, but after workpiece 26 enters apparatus 10 and starts moving through the passageway, it widens slightly until contacts the surfaces of the wheel that define the groove. The frictional forces exerted by wheel member 34, wheel member 12 and die member 36 produce a net force on workpiece 26 that drags it through the passageway in the same direction as wheel member 12. Die member 34 constrains workpiece 26 within groove 20 as it moves along until the leading end of the workpiece contacts abutment 28, which forces the workpiece through outlet channel 30. As the workpiece is extruded, it undergoes shear strain that results in grain refinement. In the current set-up, as described for apparatus 10, the angle is about 90 degrees, which is the most commonly used channel intersection angle in ECAP. The shear strain is well known and have already been described in the prior art for equal channel angular extrusion of metal billets. Preferably, the second wheel member 34 is as wide as first wheel member 12 and shoe 38, but it can also be wider or narrower, which is not critical. Second wheel member 34 widens the billet enough so that the widened billet contacts the surfaces of groove 20.

Ultrafine-grained (UFG) materials processed by Severe Plastic Deformation (SPD) have attracted attention in the research and development community in recent years. Currently, most SPD techniques produce UFG materials in a costly, batch-processing manner. This invention enables the continuous processing of metal and metal-alloy rectangular bars and wires to produce metal bars and wires with an ultrafine-grained structure and without significant changes in cross-section.

The foregoing description of the invention has been presented for purposes of illustration and description and is not intended to be exhaustive or to limit the invention to the precise form disclosed, and obviously many modifications and variations are possible in light of the above teaching. For example, while aluminum bar workpieces were used to demonstrate this invention, it should be understood that this invention is not limited to processing only aluminum, and that any metal or metal alloy workpiece could be used instead.

The embodiment(s) were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

The following references are incorporated by reference herein.

REFERENCES

1. R. Z. Valiev, I. V. Alexandrov, Y. T. Zhu and T. C. Lowe, "Paradox of Strength and Ductility in Metals Processed by Severe Plastic Deformation," Journal of Materials Research, vol. 17 (2002) pp 5–8.
2. Minoro Furukawa, Zenji Horita, and Terence G. Langdon, "Developing Ultrafine Grain Sizes Using Severe Plastic Deformation," Advanced Engineering Materials, vol. 3, no. 3 (2001) pp. 121–125.
3. U.S. Pat. No. 6,399,215 to Yuntian T. Zhu, Terry C. Lowe, Ruslan Z. Valiev, Vladimir V. Stolyarov, Vladimir V. Latysh and Georgy J. Raab entitled "Ultrafine-Grained Titanium for Medical Implants," issued Jun. 4, 2002.
4. R. Z. Valiev, R. K. Islamgaliev, and I. V. Alexandrov, "Bulk Nanostructured Materials From Severe Plastic Deformation, Progress in Materials Science, vol. 45 (2000) pp. 103–189.
5. Honggang Jiang, Y. Theodore Zhu, Darryl P. Butt, Igor V. Alexandrov, and Terry C. Lowe, "Microstructural Evolution, Microhardness and Thermal Stability of HPT-Processed Cu," Materials Science and Engineering, vol. A290 (2000) pp. 128–138.
6. U.S. Pat. No. 3,765,216 to Derek Green entitled "Extrusion," issued Oct. 16, 1973; U.S. Pat. No. 4,055,979 to Eric Hunter and Derek Green entitled "Forming of Materials by Extrusion," issued Nov. 1, 1977; U.S. Pat. No. 4,101,253 to Clifford Etherington entitled "Extrusion," issued Jul. 18, 1978; U.S. Pat. No. 5,284,428 to Uday K. Sinha and Ronald D. Adams entitled "Apparatus for Conform Extrusion of Powder Feed," issued Feb. 8, 1994; and U.S. Pat. No. 5,503,796 to Uday K. Sinha and Ronald D. Adams entitled "Method for Conform Extrusion of Powder Feed," issued Apr. 2, 1996.
7. J. Huang, Y. T. Zhu, H. Jiang and T. C. Lowe, "Microstructures and Dislocation Configurations in Bulk Nanostructured Cu Processed by Repetitive Corrugation and Straightening," Acta Materialia, vol. 49 (2001) pp. 1497–1505.
8. Y. Saito, H. Utsunomiya, H. Suzuki, and T. Sakai, "Improvement in the r-Value of Aluminum Strip by a Continuous Shear Deformation Process," Scripta Materialia, vol. 42 (2000) pp. 1139–1144.
9. J.-C. Lee, H. K. Seok, and J. Y. Suh, "Microstructural Evolutions of the AI Strip Prepared by Cold Rolling and Continuous Equal Channel Angular Pressing," Acta Materialia, vol. 50 (2002) pp. 4005–4019; U.S. Pat. No. 6,370,930 to Jae-Chul Lee, Hyun-Kwang Seok, Jong-Woo Park, Young-Hoon Chung, and Ho-In Lee, entitled "Continuous Shear Deformation Device," issued Apr. 16, 2002; U.S. Pat. No. 6,571,593 to Young-Hoon Chung, Jong-Woo Park, In-Ge Moon, and Nyung-Chul Shin, entitled "Continuous Shear Deformation Device," issued Jun. 3, 2003.
10. Y. H. Kim, J. R. Cho, K. S. Kim, H. S. Jeong, and S. S. Yoon, "A Study of the Application of Upper Bound Method to the CONFORM Process," Journal of Materials Processing Technology, vol. 97 (2000) pp. 153–157; and J. R. Cho and H. S. Jeong, "Parametric Investigation on the Curling Phenomenon in CONFORM Process by Three-Dimensional Finite Element Analysis," Journal of Materials Processing Technology," vol. 110 (2001) pp. 53–60.

What is claimed is:

1. An apparatus comprising:

a wheel member having an endless circumferential groove therein, a stationary constraint die surrounding the perimeter of said wheel member and covering most of the length of the groove and forming a passageway with the groove having a rectangular shaped cross section, an abutment member projecting from the stationary constraint die into the groove and blocking one end of the passageway, the wheel member being rotatable relative to the stationary constraint die in the direction toward the abutment member, an output orifice in the stationary constraint die adjacent the abutment member and having substantially the same cross section as the cross section of the passageway, and an input orifice for feeding a solid metal workpiece to be pressed into a portion of the passageway remote from the abutment member so that the workpiece is carried in the groove by frictional drag in the direction towards the abutment member and is thereby extruded through the output orifice and without any substantial change in cross section.

2. The apparatus of claim 1, wherein said wheel member comprises a first wheel member portion and a second wheel member portion.

3. The apparatus of claim 1, wherein the rectangular cross section comprises a square cross section.

4. A method for continuously extruding metal, comprising:

feeding a solid metal workpiece into one end of a passageway formed between a wheel member having an endless groove and a stationary constraint die that surrounds the wheel member and covers some of the length of the groove, the wheel member having a greater surface area for engaging the metal workpiece than the stationary constraint die, the passageway having a closed end remote from said one end and having a outlet through said stationary constraint die at said closed end, the passageway and outlet having substantially the same rectangular cross section.

and moving the wheel member relative to the stationary constraint die in a direction towards the outlet from said one end to said closed end such that the frictional drag of the passageway defining surfaces of the second member drags the metal workpiece through the passageway and through the outlet.

5. The method of claim 4, wherein the extruded metal workpiece is rotated by 180 degrees and extruded again.

6. The method of claim 4, wherein the rectangular cross-section is a square cross section.

7. The method of claim 6, wherein the extruded metal workpiece is rotated by 90 degrees and extruded again.

8. An apparatus comprising:

a first wheel member having an endless circumferential groove therein, a shoe member covering only part of the length of the groove and forming an input orifice with the groove and a passageway with the groove, the passageway having a rectangular cross section, the input orifice comprising an orifice for feeding a solid metal workpiece to be extruded into a portion of the passageway remote from the abutment member, the first wheel member having a greater surface area for engaging the metal workpiece than the shoe member, an abutment member projecting from the shoe member into the groove and blocking one end of the passageway, the first wheel member being rotatable relative to the shoe member in the direction toward the abutment member, the output orifice having substantially the same cross section as the cross section of the passageway an output orifice in the shoe member adjacent the abutment member, and a second rotatable wheel member remote from the abutment member of the shoe, the second rotatable wheel member configured to contact a side of the workpiece and urge the workpiece into the passageway such that the workpiece is carried in the groove by frictional drag in the direction towards the abutment member and is thereby extruded through the output orifice and without any substantial change in cross section.

9. The apparatus of claim 8, wherein said wheel member comprises a first wheel member portion and a second wheel member portion.

10. The apparatus of claim 8, wherein the rectangular cross section comprises a square cross section.

* * * * *